US007828174B2

(12) United States Patent
Doehnert et al.

(10) Patent No.: US 7,828,174 B2
(45) Date of Patent: Nov. 9, 2010

(54) PACKAGING ASSEMBLY FOR FLOWABLE MATERIALS

(75) Inventors: Detlef Doehnert, Ludwigshafen (DE); Richard Garnett, Hereford (GB); Roy Metcalf, Cheadle (GB)

(73) Assignees: BASF SE, Ludwigshafen (DE); Wisdom Agricultural (Investments) Limited, Bristol (GB)

( * ) Notice: Subject to any disclaimer, the term of this patent is extended or adjusted under 35 U.S.C. 154(b) by 678 days.

(21) Appl. No.: 11/720,147

(22) PCT Filed: Nov. 25, 2005

(86) PCT No.: PCT/EP2005/012635

§ 371 (c)(1),
(2), (4) Date: May 24, 2007

(87) PCT Pub. No.: WO2006/056461

PCT Pub. Date: Jun. 1, 2006

(65) Prior Publication Data

US 2008/0121639 A1 May 29, 2008

(30) Foreign Application Priority Data

Nov. 26, 2004 (EP) ..... 04028154

(51) Int. Cl.
*B65D 35/56* (2006.01)

(52) U.S. Cl. ..... 222/105; 220/495.01

(58) Field of Classification Search ..... 222/95, 222/105, 173, 106, 211, 464.1, 464.7, 181.1, 222/189.1; 141/313–317, 392; 220/495.01–495.06
See application file for complete search history.

(56) References Cited

U.S. PATENT DOCUMENTS

| | | | | | |
|---|---|---|---|---|---|
| 3,173,579 | A | * | 3/1965 | Curie et al. | 222/105 |
| 4,286,636 | A | * | 9/1981 | Credle | 141/114 |
| 4,874,023 | A | * | 10/1989 | Ulm | 141/346 |
| 5,031,676 | A | * | 7/1991 | Ulm | 141/346 |
| 5,377,876 | A | * | 1/1995 | Smernoff | 222/105 |
| 5,526,956 | A | * | 6/1996 | Osgar | 222/83 |
| 6,644,367 | B1 | | 11/2003 | Savage et al. | |

FOREIGN PATENT DOCUMENTS

| | | | | |
|---|---|---|---|---|
| JP | 2000-272661 | * | 10/2000 | 222/105 |
| JP | 2001-294269 | * | 10/2001 | 222/105 |
| WO | 9638349 A1 | | 12/1996 | |
| WO | 9845188 A1 | | 10/1998 | |

* cited by examiner

*Primary Examiner*—Lien T Ngo
(74) *Attorney, Agent, or Firm*—Rothwell, Figg, Ernst & Manbeck, p.c.

(57) ABSTRACT

The present invention is directed to a packaging assembly for flowable materials comprising a casing (1) having at least one opening (9), a valve assembly (7) mounted in the opening (9) of the casing (1) and a flexible liner (23) for accommodating the flowable material, said flexible liner (23) being housed in the casing (1) and connected to the valve assembly (7), whereby the valve assembly (7) comprises a dry break extractor valve (17) for closed transfer dispense of the flowable material.

26 Claims, 15 Drawing Sheets

PACKAGING ASSEMBLY FOR FLOWABLE MATERIALS

CROSS REFERENCE TO RELATED APPLICATION

This application is a 35 USC §371 National Phase Entry Application from PCT/EP2005/012635, filed Nov. 25, 2005, and designating the United States.

The present invention relates to a packaging assembly for flowable materials comprising a casing and a valve assembly.

The packaging assembly may be used for any flowable material. For example, hazardous, aseptic or easily oxidised products such as chemicals and pesticides may be packed and shipped using the packaging assembly. Currently, stainless steel or plastic containers are used for packaging and shipping pesticides from the point of manufacture to the end user.

Current packaging solutions are divided into two main groups, namely single trip disposable containers and multi trip reusable and refillable containers. Single trip disposable containers have the disadvantage of causing a large amount of waste. Multi trip containers may cause problems of cross-contamination. If the reusable and refillable container is filled with different products, the inside of the container must be cleaned in order to avoid cross-contamination, which is a costly and laborious process. Further deficiencies include end of life disposal requirements, container panelling, the large volume occupied when empty and product drying and degrading.

In the current commercial and regulatory environment, pressure is focusing on finding the lowest cost structure for achieving the most efficient and compliant packaging method with the lowest impact on the environment. The key drivers of this situation are the regulations requiring a reduction in packaging waste created in the workplace, the increasing costs of landfill, and the control of waste disposal through incineration of irreplaceable resources like plastics derived from petrochemicals. Allied to this are particular requirements to control the end user dispense of some products and prevent accidental losses or contamination of the products contained in the packaging.

So-called bag-in-box packaging assemblies are also known, in particular for beverages. In such systems, the pourable product is dispensed from a flexible bag that is contained within the outer box. The dispensing of the liquid is carried out by means of the force of gravity. Furthermore, pressurised liquids can be stored so that dispense is carried out by means of the pressure within the bag. However, such systems cannot be used for materials with which the end user must not come into contact. Known packaging assemblies for liquids do not assure that the beverage will not leak out of the packaging assembly before or after it has been opened.

It is therefore the object of the present invention to provide a packaging assembly which is low-cost, causes less waste and which is safe for use with hazardous, non hazardous, aseptic or easily oxidised flowable materials.

A packaging assembly having the features of claim 1 has achieved this object and advantageous embodiments are given in the features of the sub claims.

According to the invention, the packaging assembly for flowable materials comprises a casing having at least one opening, a valve assembly mounted in the opening of the casing, and a flexible liner for accommodating the flowable material, said flexible liner being housed in the casing and connected to the valve assembly, whereby the valve assembly comprises a dry break extractor valve adapted to be coupled to a corresponding coupler for closed transfer dispense of the flowable material.

Due to the use of the dry break extractor valve, a closed transfer dispense can be achieved. This is particularly advantageous in case hazardous, aseptic or easily oxidised products are to be dispensed without the risk of unintended contamination of the surrounding environment, the material contained and being transferred or the end user.

The use of the casing which houses the flexible liner with the flowable material advantageously provides a second containment device increasing the inherent safety for use with products where leakage may cause contamination problems. In the event of a liner leaking, the contents within the casing may still be removed in a usual manner without decontamination being necessary until the liner is removed from the casing. Furthermore, it is advantageous that the casing can be used and reused with a wide range of products, as it does not come into direct contact with the product. Furthermore, due to the use of the liner, decontamination is almost unnecessary and the risk of cross-contamination does not occur. Moreover, the casing may advantageously be provided with exterior features that permit safe and efficient stacking of the packaging assembly on pallets and in stores. Due to the use of the flexible liner, the residue volumes achieved in the liner after extraction has been completed are very low.

According to one aspect of the present invention, the casing is reusable and the liner is disposable. Furthermore, the valve assembly may also be disposable. The use of a multi trip casing and a disposable sealed liner advantageously reduces the mass of packaging material used per unit of material packed and, further, reduces the volume and cost of waste that is shipped to disposal sites. Therefore, the valve assembly of the present invention has less of an impact on the environment.

According to a further aspect of the present invention, the liner and the valve assembly are also reusable, thereby further reducing the volume and cost of waste.

According to a further aspect of the present invention the casing is disposable and the liner and the valve assembly are also disposable and/or reusable.

According to a further aspect of the present invention, the packaging assembly further comprises a tamper evidence device sealing the opening of the casing. Said tamper evidence device prevents, on the one hand, the replacement of the liner and, on the other hand, the filling and dispensing a product to or from the inside of the liner. The tamper evidence device may comprise a first section which seals a dispense opening of the valve assembly and a second section which seals the part of the opening of the casing which provides access to the space between the inside of the casing and the liner. A tamper evidence device advantageously protects the manufacturer of the product filled in the packaging assembly against customer claims regarding product volume and quality while assuring that the correct volume and quality of product is delivered to the end user. Moreover, the tamper evidence device has a second function as a seal of the opening of the casing so that it prevents the escape of any product that may have leaked into the space between the liner and the casing due to material failure of the liner or due to accidental damage of the liner. This twin layer packaging system greatly increases the security of the material in transit.

According to a further aspect of the present invention, the tamper evidence device is adapted to be used once only. It is irreparably damaged when removed so that unauthorised replacement of the liner or dispensing or filling of the product in or from the liner can easily be detected.

According to a further aspect of the present invention, the casing comprises a recess in which the tamper evidence device is fixed. Thus, the tamper evidence device can be fixed in the recess without forming a protrusion. As a result, unintentional breaking of the tamper evidence device during transport can essentially be avoided.

According to a further aspect of the present invention, the opening of the casing has a first section formed to receive the valve assembly and a second section formed so that the liner connected to the valve assembly may be brought in or out of the casing. The second section is preferably formed by two aligned slits arranged on opposite sides of the first section of the opening. Thus, the liner, which is empty but already fixed to the valve assembly, can be thread through the slits so as to be placed inside the casing. The valve assembly may then be fixed in the first section of the opening of the casing whereupon the tamper evidence device is fixed thereupon.

According to a further aspect of the present invention, the valve assembly and a rim of the liner are sealed to one other. Preferably, the valve assembly comprises one or more ribs to which the rim of the liner is sealed. More preferably, the rim is sealed to the valve assembly by welding. Such a connection between the liner and the valve assembly prevents any leakage of material from the inside of the liner to the space between the liner and the casing.

According to a further aspect of the present invention, the valve assembly comprises a self-sealing valve sealing the inside of the liner from the outside of the packaging assembly. The self-sealing valve can only be opened by connecting a particular corresponding coupler to the dry break extractor valve for a closed transfer of the flowable material. It is an important benefit of the present invention that the dry break coupling guarantees that the user cannot unintentionally come into contact with the stored material when it is being dispensed.

Once the corresponding coupler is connected to the dry break extractor valve, applying negative pressure to the coupler will dispense the flowable material. In a further embodiment the pressure differential to achieve the product dispense may be achieved by raising the pressure between the casing and the liner.

For example, fluid may be inserted in order to raise the pressure between the casing and the liner. Furthermore, the volume of the inserted fluid may be metered.

According to a further aspect of the present invention, the valve assembly is connected to a dip tube that extends from the valve assembly to a point close to the bottom of the liner. This way, the very bottom of the liner can be drained too. The dip tube may be flexible. Preferably Straps that extend from the tube to anchor points on the circumferential sections of the liner secure the dip tube. These measures assure that the dip tube does not damage the liner and is always located in the most advantageous position for emptying the liner.

According to a further aspect of the present invention, the dry break extractor valve comprises an opening for receiving the corresponding coupler, additionally the two side parts opposite one another taper away from said opening. Preferably, the tapered side parts end where the slits of the opening of the casing begin. The tamper evidence device then preferably seals the opening of the dry break extractor valve as well as the slits.

According to a further aspect of the present invention, the flexible liner is adapted to expand essentially in relation to the inner volume and form of the casing. Thus, the liner is advantageously constructed so as to occupy a minimum volume when empty and accommodates the desired volume when filled. The material of the flexible liner may be formed by one or more layers selected for their chemical compatibility and mechanical strength and has a form commensurate with that of the casing and the required volume.

According to a further aspect of the present invention, the casing comprises a pressure balance valve, whereby said pressure balance valve permits the entry of a gas, e.g. air, into the space between the casing and the liner while prohibiting the escape of the flowable material in the event of any leakage arising from accidental damage. The pressure balance valve may contain a membrane, for example a Gortex® membrane, or a spring-actuated non-return or one-way valve. Such a valve advantageously permits the entry of air so that the collapsing of the liner is facilitated in response to the resulting pressure drop when material is dispensed. Simultaneously, the valve prohibits the escape of material that can enter the space between the liner and the casing due to a rupture of the liner. Therefore, even if such a rupture should occur, the outside of the casing and the general environment would not be contaminated.

According to a further aspect of the present invention, the dip tube incorporates a groove that is open to the inside of the liner. The groove is advantageously open to the pressure balance valve so that a gas such as air can travel from the top of the liner to the bottom and so be used to displace the final residue from the liner and centre of the dip tube.

According to a further aspect of the present invention, the casing comprises a recess or pocket for a transponder tracking device. This device can be fixed to assist in the management of the packing assembly from the filling site to the customer and back. Alternatively, or in addition, provision is also made for a bar code marking system. A further feature of the packaging assembly may be recessed panels on each face of the casing to accept a label, e.g. sleeve label containing statutory or marketing information.

The material of the casing is dictated by the product type, performance characteristics, logistic constraints and market requirements. Advantageously, it may be formed from a suitable polymer. The polymer can be translucent and may be used together with a calibrated transparent sleeve label section to permit observation of the product level through the label and the packaging assembly.

According to a further aspect of the present invention, the casing comprises two or more openings and two or more flexible liners housed in the casing and two or more valve assemblies mounted in the respective openings and coupled with the respective liners. This facilitates the marketing and transport of separate materials used in the same process by the end user.

Embodiments of the present invention will now be described by way of example with reference to the accompanying drawings.

Figure 1:
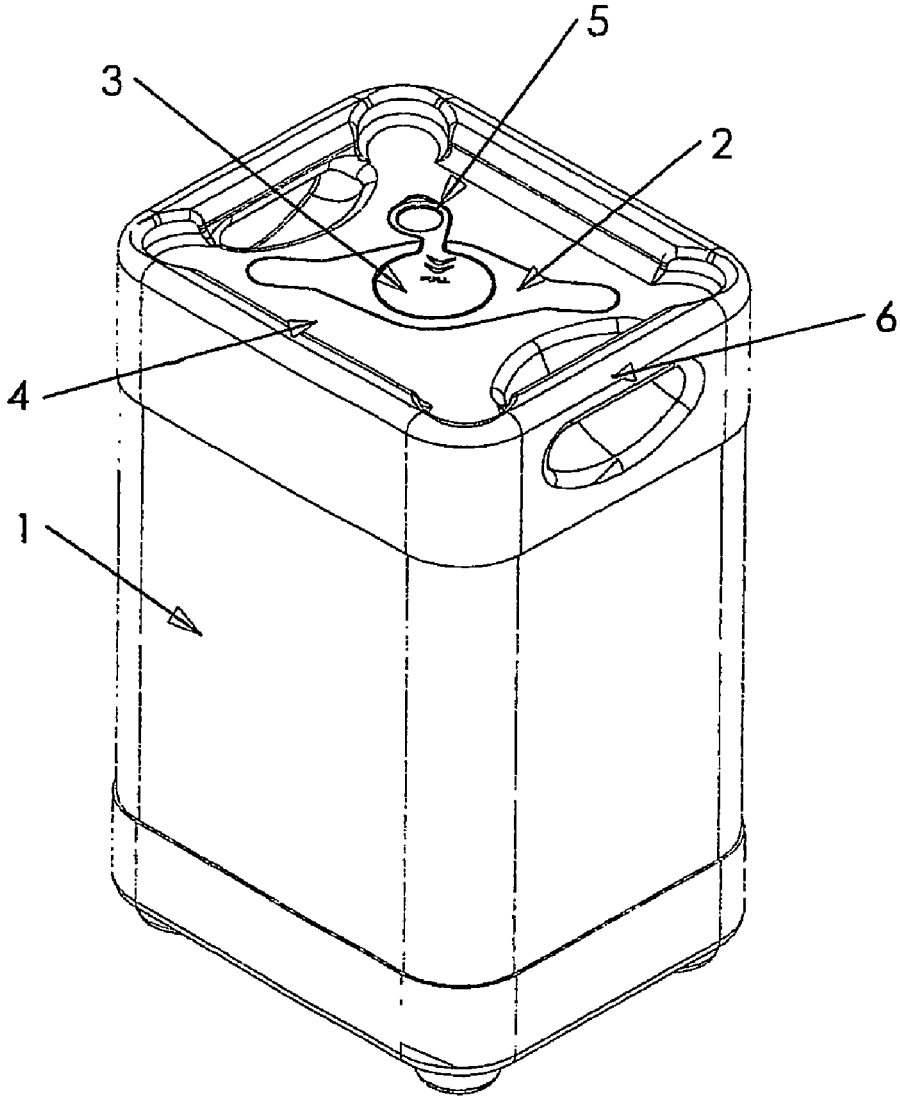
FIG. 1 shows a perspective view of an embodiment of the present invention.
Figure 6:
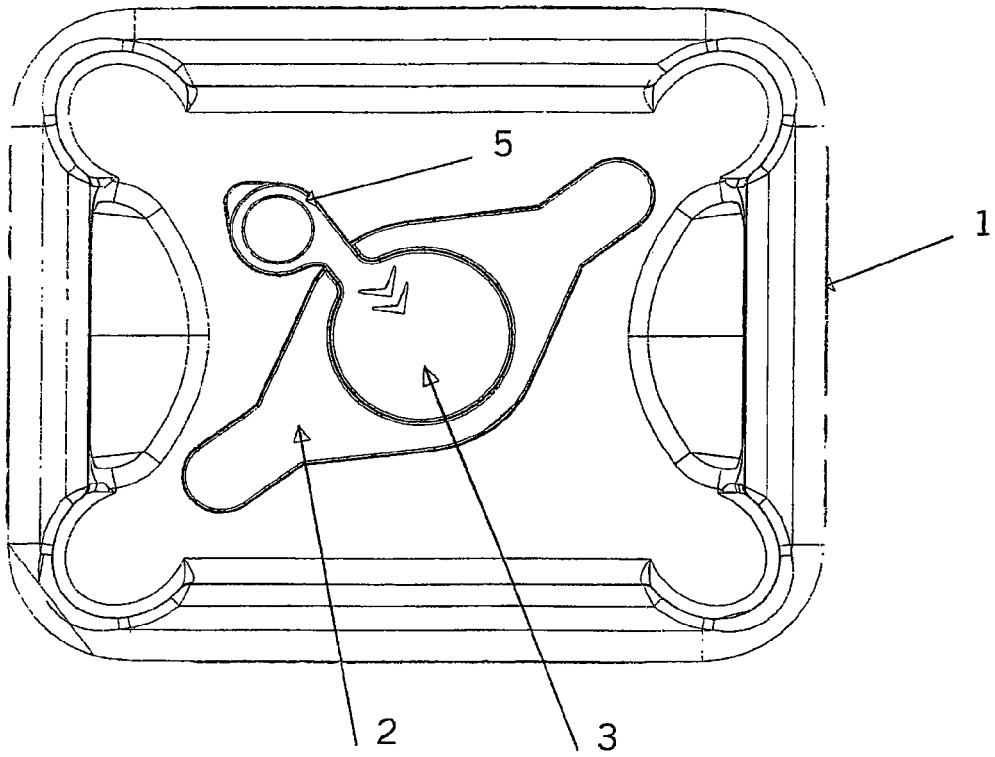
FIG. 6 shows the embodiment shown in FIG. 1 from above.

FIG. 1 shows a preferred embodiment of the packaging assembly according to the present invention. FIG. 6 shows this packaging assembly from above. The packaging assembly comprises a jacket or casing 1. The corners and edges are rounded and, on top, the casing 1 preferably comprises two carrier handles 6. However, the casing 1 may also comprise one handle or more than two handles. These handles 6 are ergonomically designed to suit each particular application and provide comfortable manual handling conditions. The shape of the casing 1 may be cubic. However, any other suitable shape is possible.

The dimensions of the casing depend on the intended use and material with which the packaging assembly is to be filled. The casing 1 can have a volume in the range of 0.5 l to 1000 l. The volume of the casing 1 of the present embodiment is 25 l. The casing 1 is formed from a suitable polymer so as to provide a robust, protective casing for the other parts housed in the casing 1. The casing 1 of the package, in this embodiment of the assembly is reusable.

Figure 4:
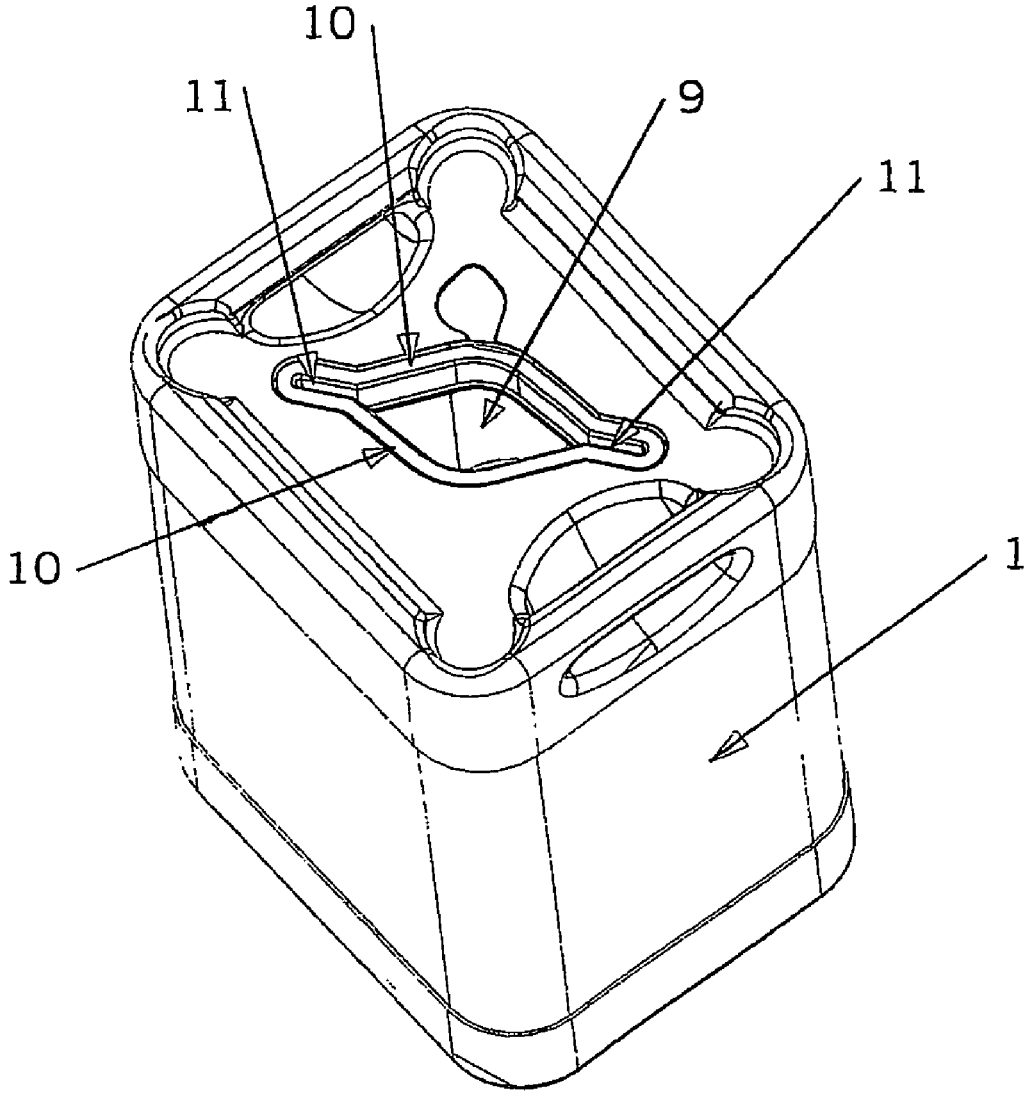
FIG. 4 shows a perspective view of the embodiment shown in FIG. 1, wherein the tamper evidence device and the valve assembly are removed.

As can be seen from FIG. 4, the top of the casing 1 comprises an opening 9. The opening 9 has a first section formed to receive the valve assembly 7 and a second section formed for bringing a liner 23 in and out of the casing 1. The second section is formed by two aligned slits 11 arranged on opposite sides of the first section of the opening 9.

Returning to FIG. 1, it can be seen that the opening 9 including the slits 11 are sealed by a tamper evidence device 4 that comprises a first section 2 and a second section 3. Furthermore, the second section 3 is connected to a ring 5 for pulling off the second section 3 of the tamper evidence device 4. The casing 1 comprises a recess 10 surrounding the opening 9 (see FIG. 4). The tamper evidence device 4 is fixed in this recess in a manner so that it cannot be removed without being irreparably damaged. The tamper evidence device 4 can therefore only be used once and must be replaced after each use of the casing 1.

Figure 2:
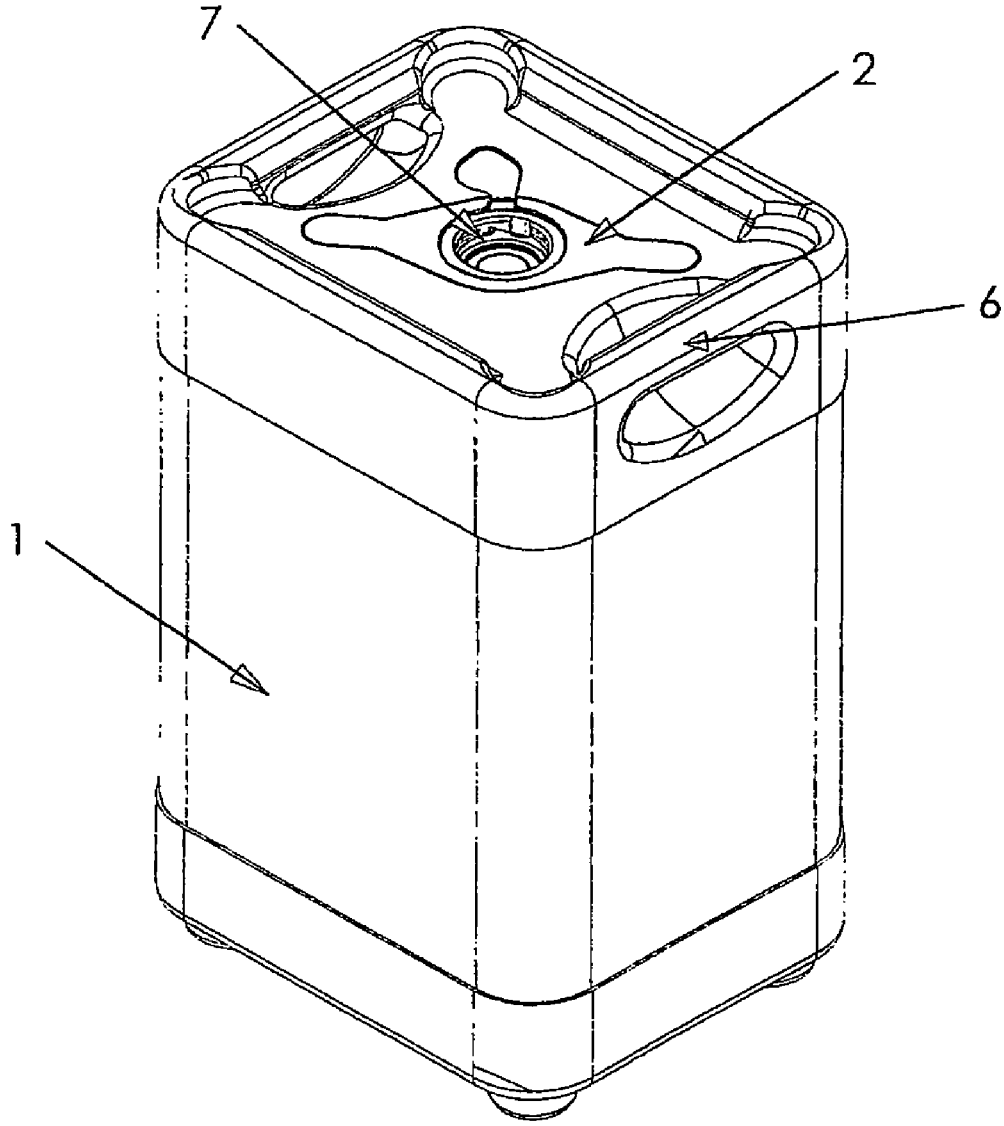
FIG. 2 shows a perspective view of the embodiment shown in FIG. 1, wherein the first part of the tamper evidence device is removed.
Figure 7:
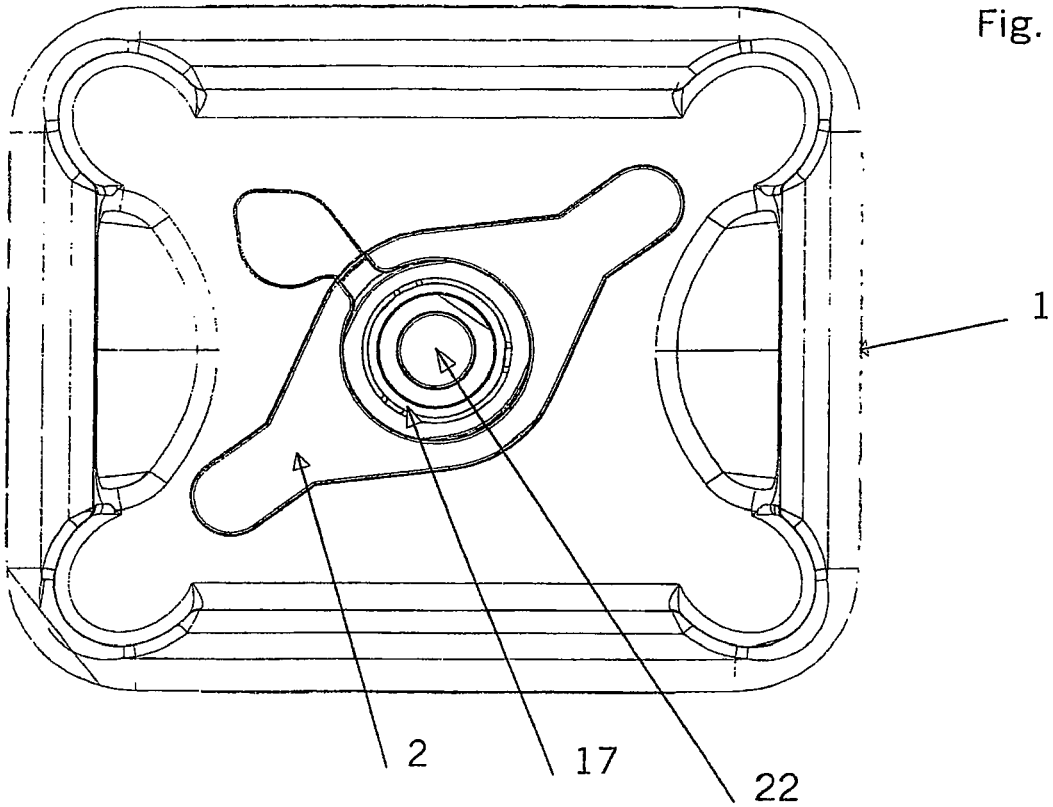
FIG. 7 shows the illustration in FIG. 2 from above.
Figure 8:
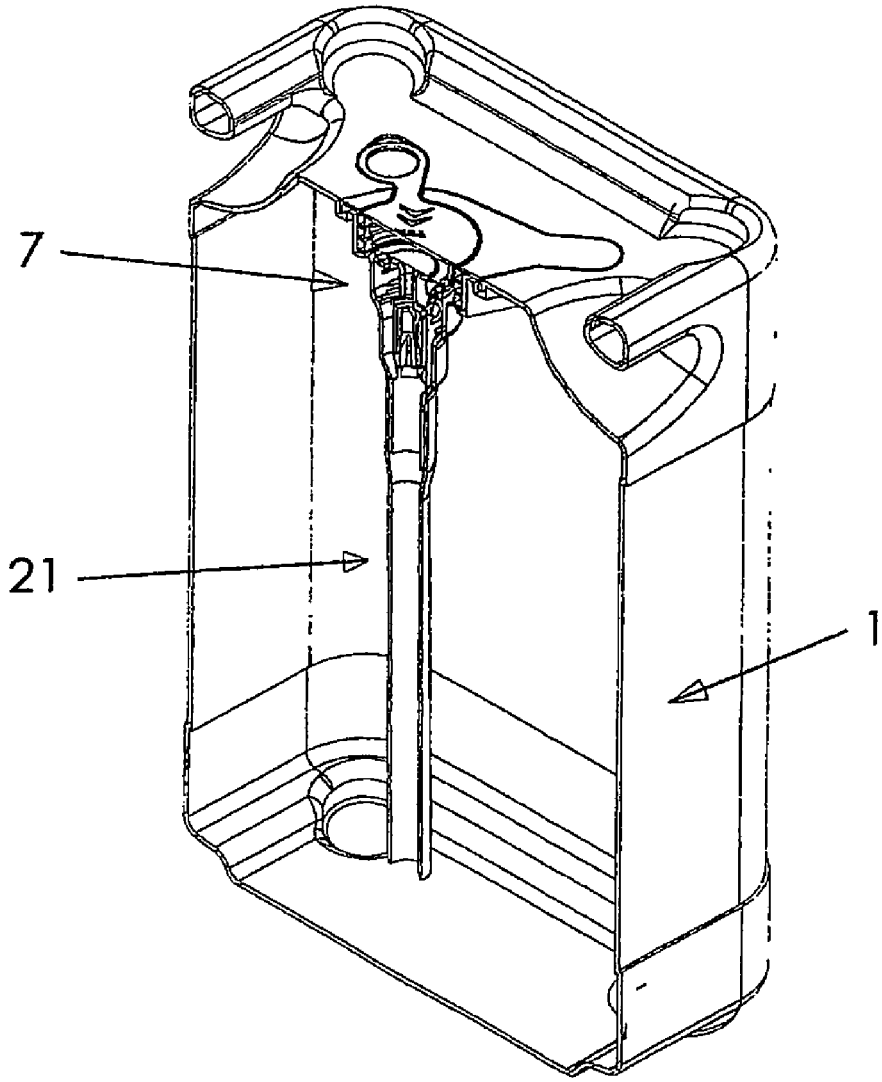
FIG. 8 shows a sectional view of the illustration in FIG. 1.
Figure 9:
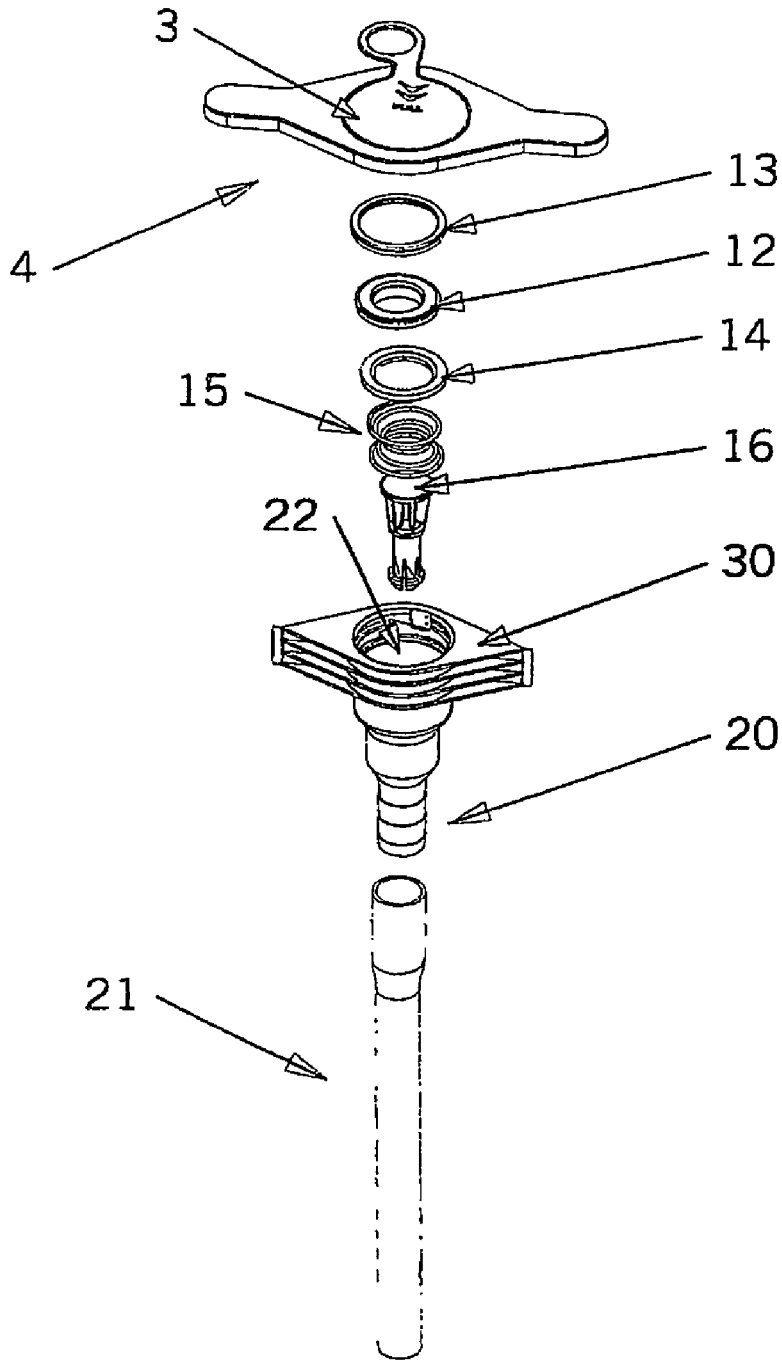
FIG. 9 shows an exploded view of the valve assembly as well as the tamper device and the dip tube.
Figure 10:
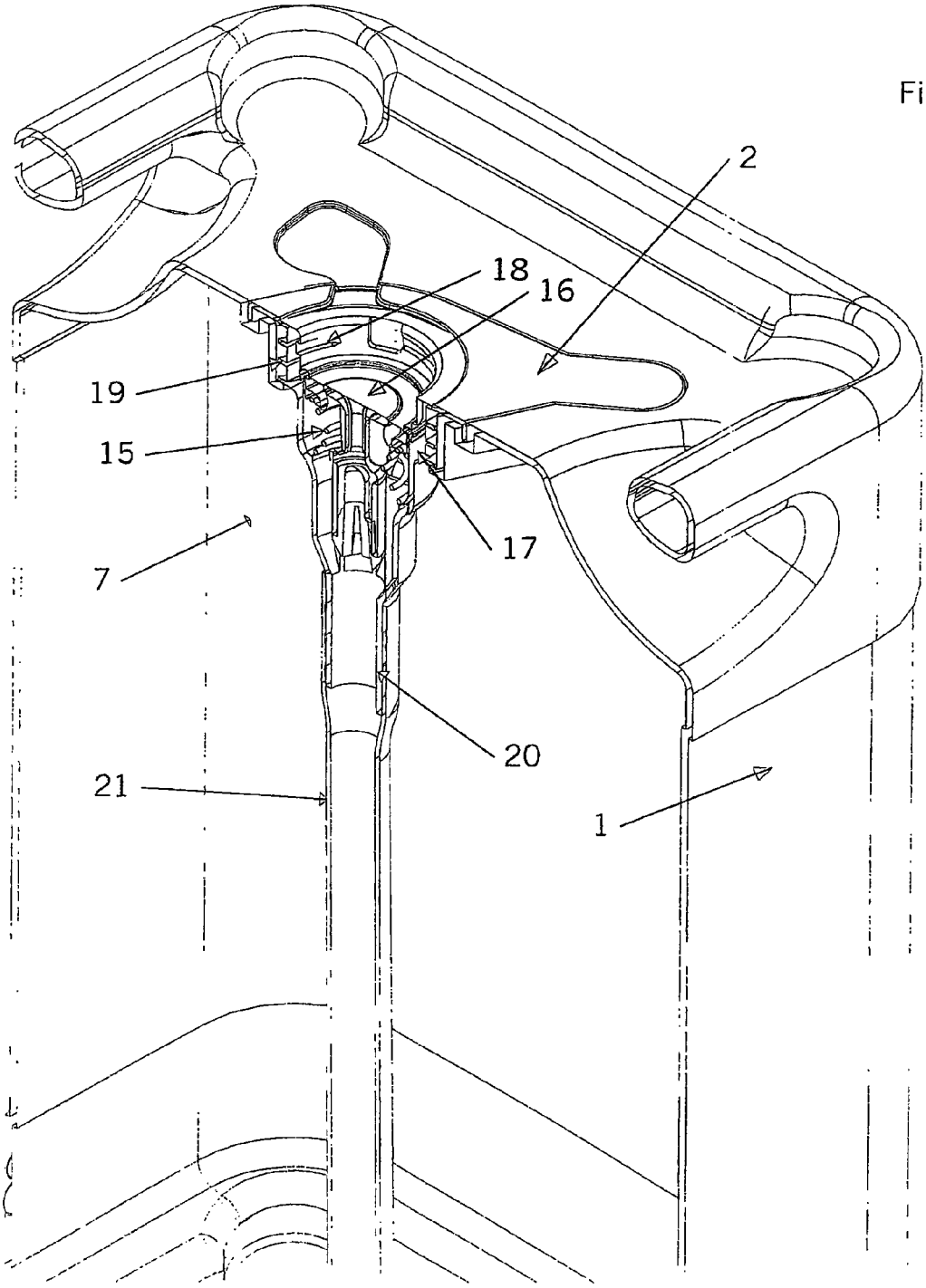
FIG. 10 shows a detailed sectional view of the illustration in FIG. 2.

FIG. 2 shows the packaging assembly, wherein the second section 3 of the tamper evidence device 4 has been removed using the ring 5. In removing the section 3 material is severed and cannot be rejoined. FIG. 7 shows this state from above. The valve assembly 7, which will be described in greater detail below, is uncovered. It has a dry break extractor valve 17 and an opening that can be seen better in the section views described below.

Figure 3:
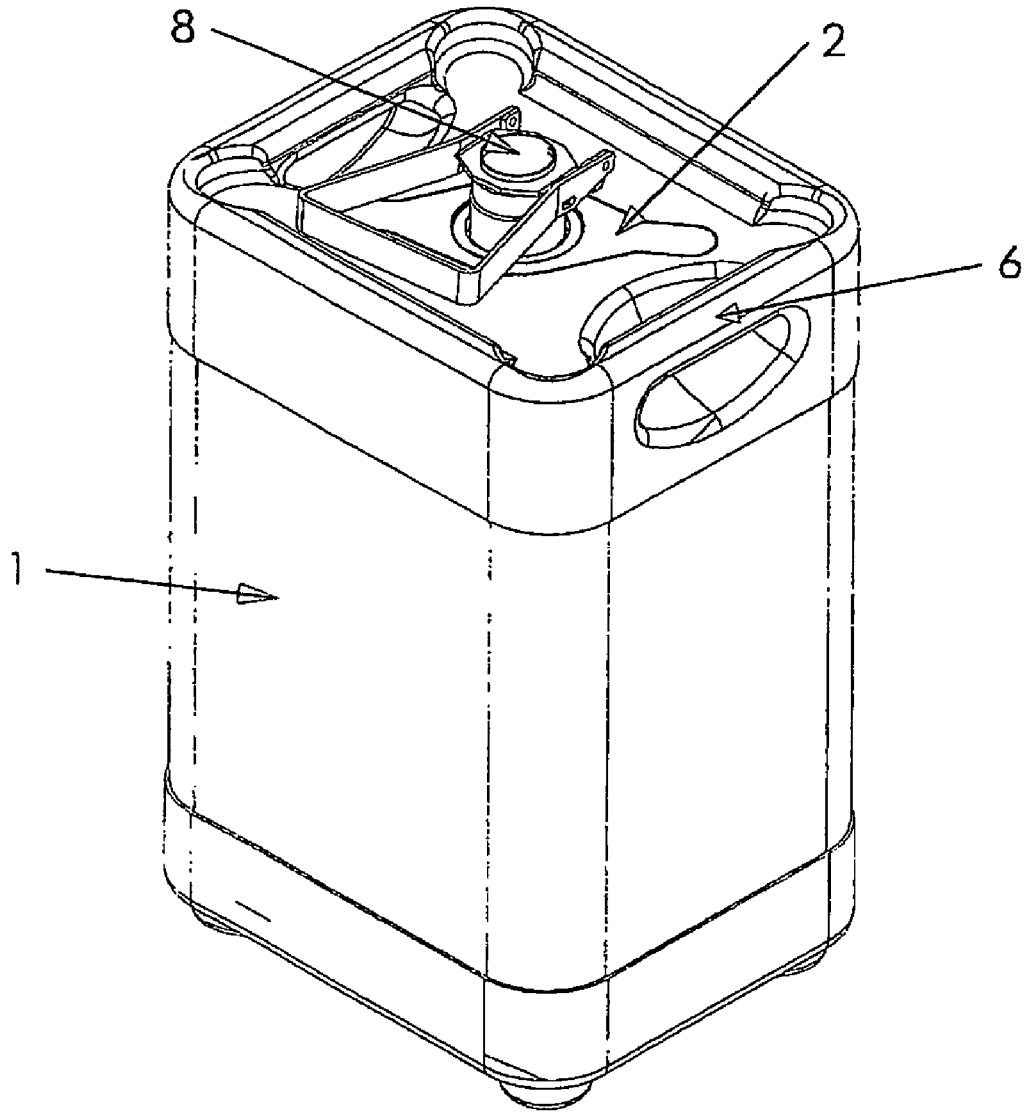
FIG. 3 shows the embodiment shown in FIG. 1, wherein the corresponding coupler is coupled with the dry break extractor valve.

FIG. 3 shows the packing assembly connected to a corresponding coupler 8 supplied by the end user. The corresponding coupler 8 is releaseably engaged with the dry break extractor valve 17, with which the valve of the valve assembly 7 is opened. In fact, this is the only way to open this valve so as to assure a safe transfer of the material stored in the packaging assembly to the end user's equipment.

Figure 5:
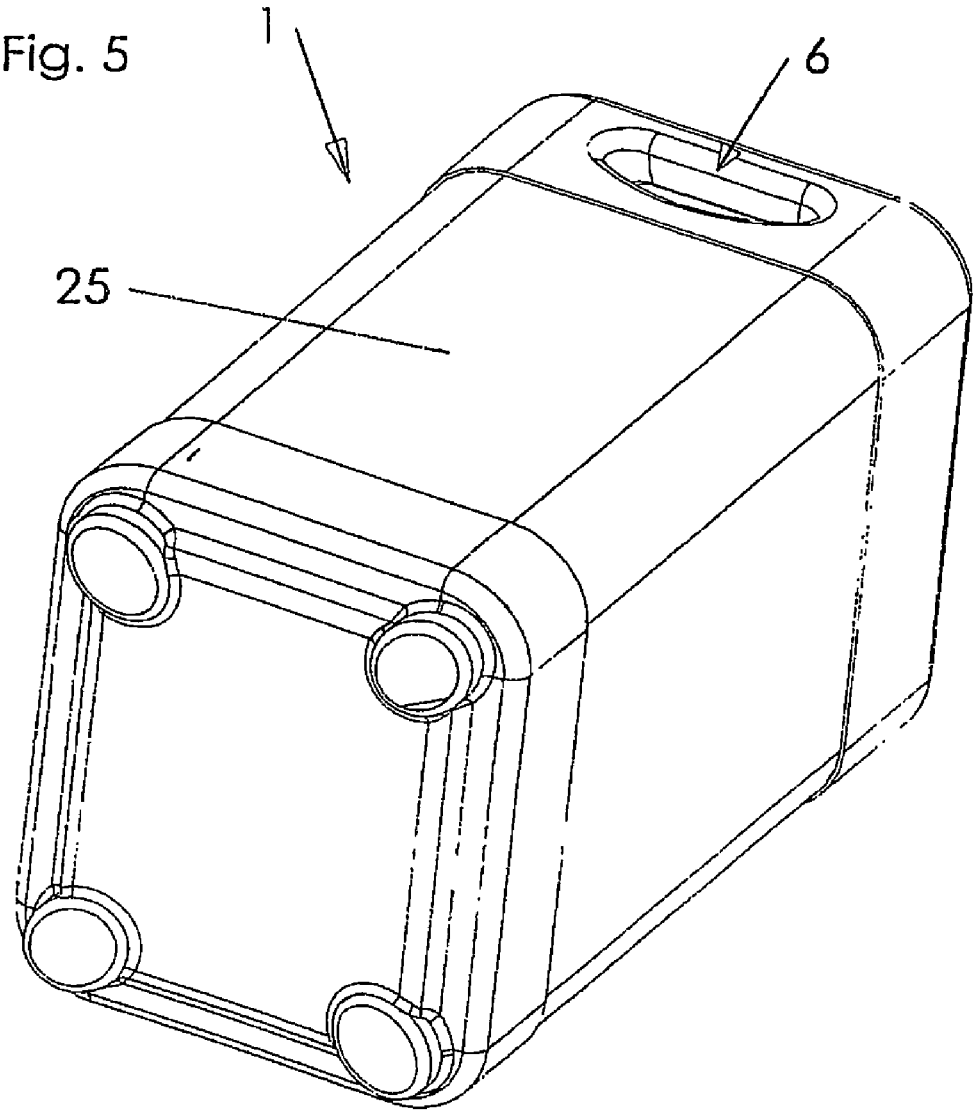
FIG. 5 shows a perspective view of the embodiment shown in FIG. 1 from below.

FIG. 5 shows the packaging assembly from below. It can be seen that the casing 1 permits safe and efficient stacking of the assembly on pallets or in stores.

The arrangement of the valve assembly 7, the tamper evidence device 4 and the dip tube 21 will now be described with reference to FIGS. 8 to 14.

The valve assembly 7 comprises a dry break extractor valve 17. The dry break extractor valve 17 has an opening 22 for coupling with a user's corresponding coupler 8 and for dispensing the flowable material stored within the packaging assembly. For coupling with the corresponding coupler 8 the dry break extractor valve 17 comprises grooves 18 and other means for a closed and leak-proof coupling.

The opening 22 is formed within a body 30 of the valve assembly 7 and is flanked by two opposite side parts which taper away from the opening 22. The outer shape of the body 30 corresponds to the inner shape of the first section of the opening 9 of the casing 1. Thus, the valve assembly 7 can be inserted into the opening 9 of the casing 1. When inserted, the tapered parts of the body 30 end where the slits 11 of the opening 9 of the casing 1 begin.

When the valve assembly 7 is inserted in the opening 9 of the casing 1, the first section 2 of the tamper evidence device 4 covers the slits 11 as well as the top face of the dry break extractor valve 17. However, the first section 2 leaves the opening 22 of the dry break extractor valve 17 open. This opening 22 is closed and sealed by a second section 3 of the tamper evidence device 4.

The dry break extractor valve 17 is integral to the body of the valve assembly 7. In particular, the following elements are inserted through the opening 22 in order to rest within the body of the valve assembly 7: a centre post 16, a spring 15, a seal support 14, a seal ring 12. When the valve assembly 7 is assembled, the spring 15 presses the seal support 14 and seal 12 up against the outer edge of centre post 16 and the underside edge of the retaining ring 13 so that the liquid channel created in the centre post 16 of the valve assembly 7 is closed.

Figure 11:
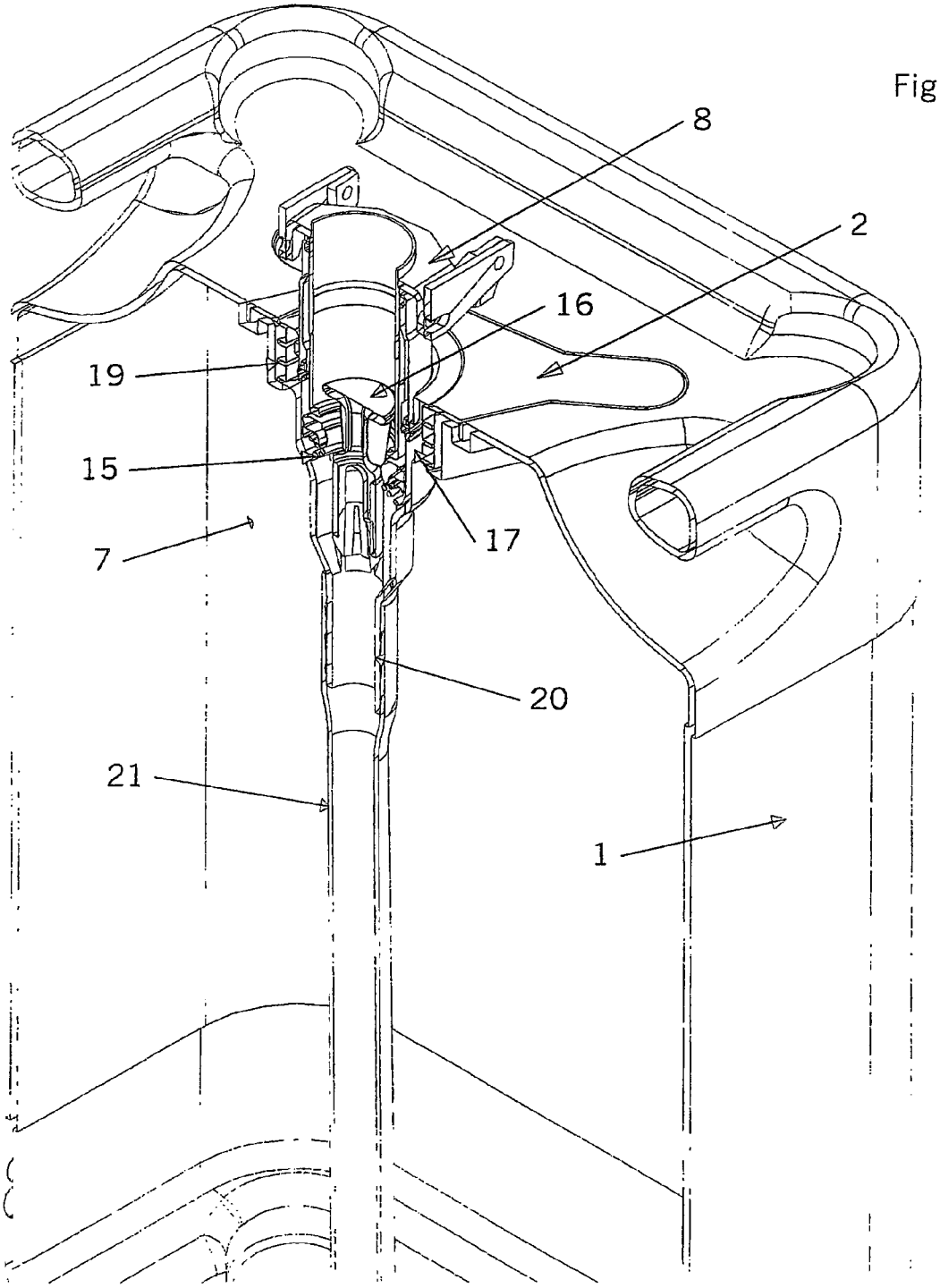
FIG. 11 shows a detailed sectional view of the illustration in FIG. 3.
Figure 12:
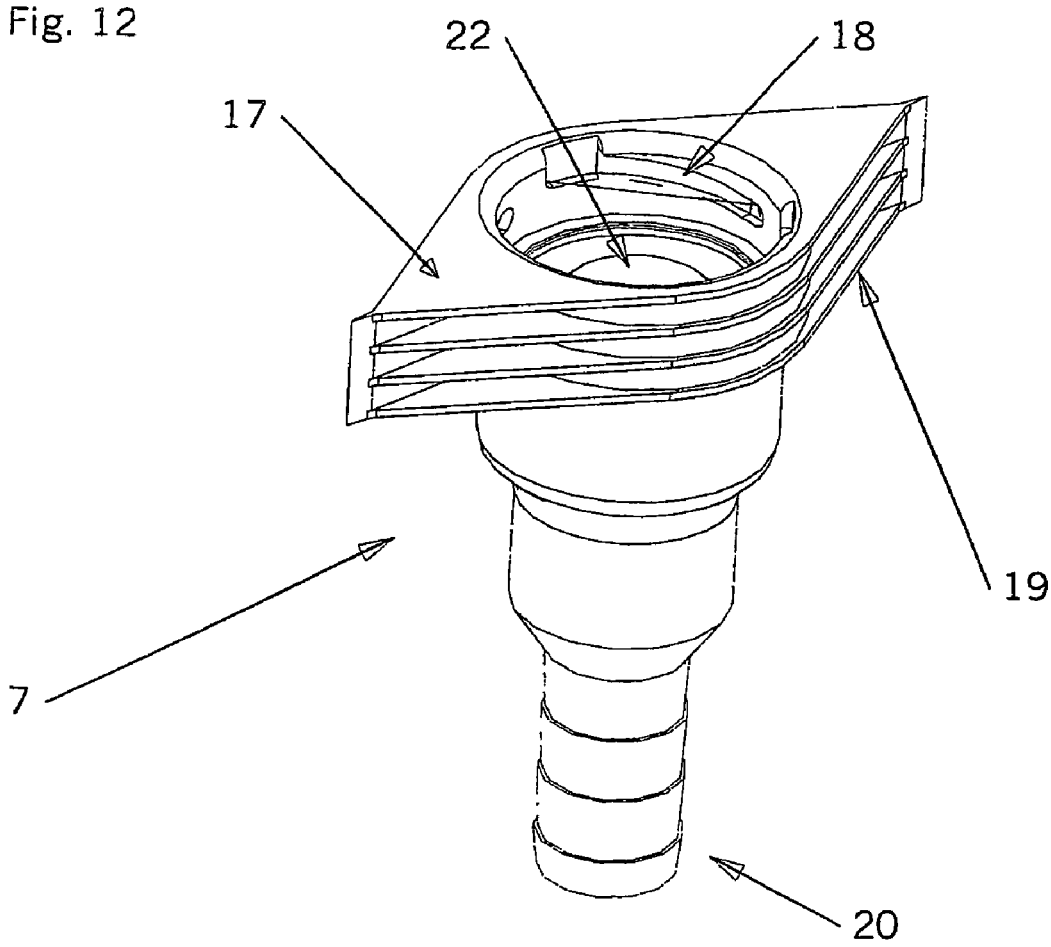
FIG. 12 shows a perspective view of the valve assembly.
Figure 13:
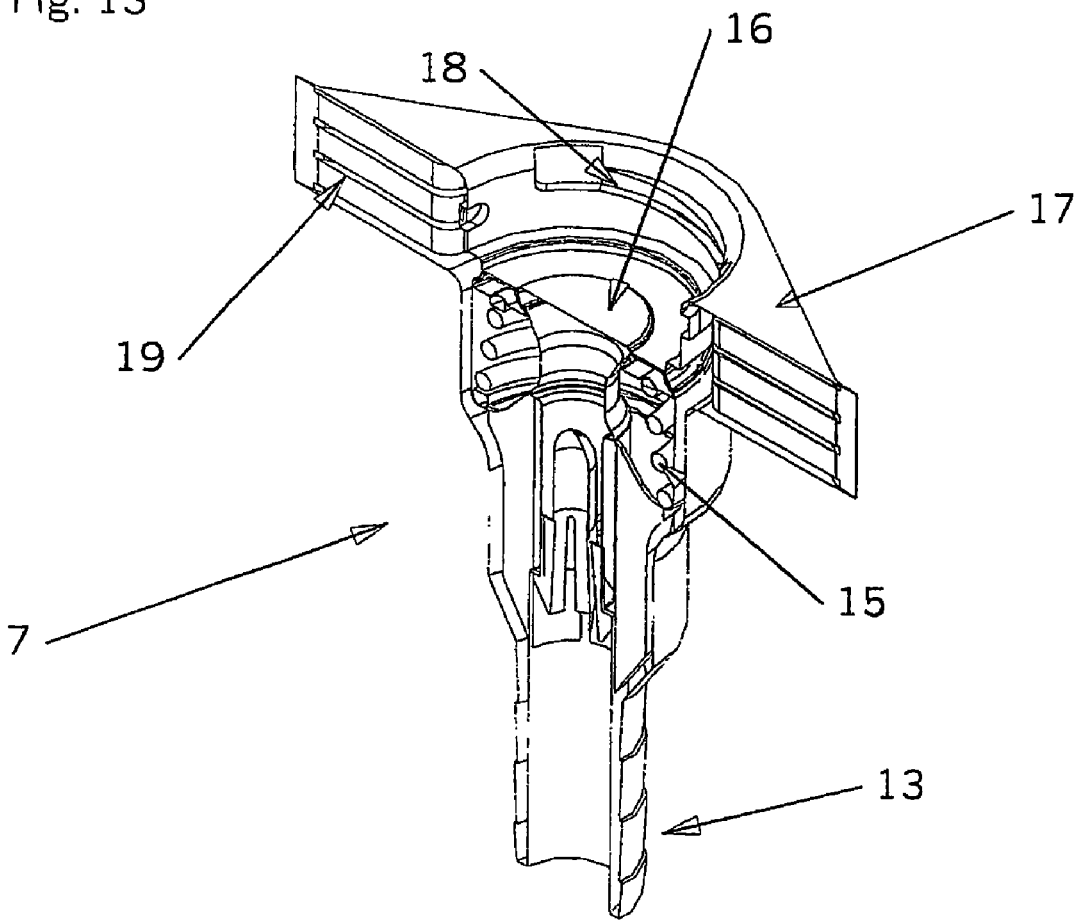
FIG. 13 shows a sectional view of the illustration in FIG. 12.
Figure 14:
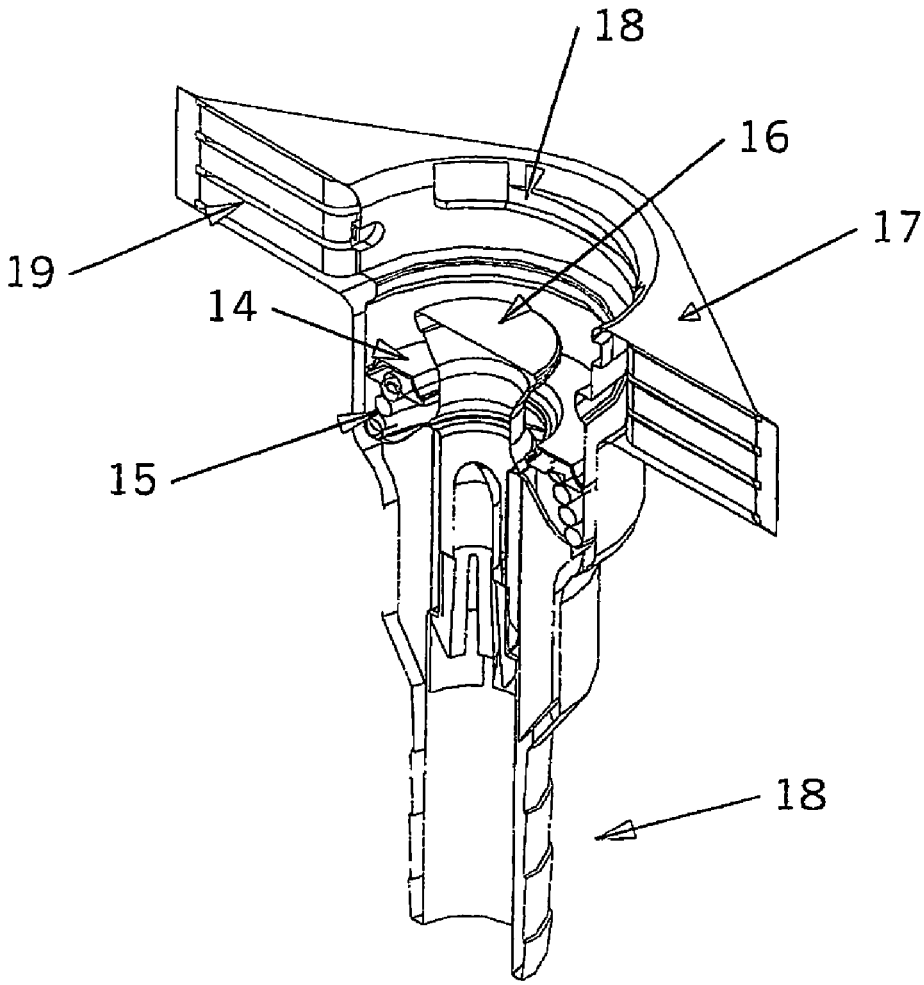
FIG. 14 shows the illustration in FIG. 13, whereby the valve is open.

As can be seen from FIG. 11, the valve can only be opened by inserting the corresponding coupler 8 which presses the seal ring 12 down against the force of the spring 15 so that the liquid channel is opened. It is a feature of the dry break extractor valve 17 that the opening 22 is sealed from the outside by the corresponding coupler 8 before the corresponding coupler 8 opens the valve. This feature assures that no material may leak to the outside.

The body of the valve assembly 7 extends to a connection 20 to which a dip tube 21 is sealably connected. The dip tube 21 is flexible and extends to a point near the bottom of the liner and the casing 1, respectively, as will be explained below.

Figure 15:
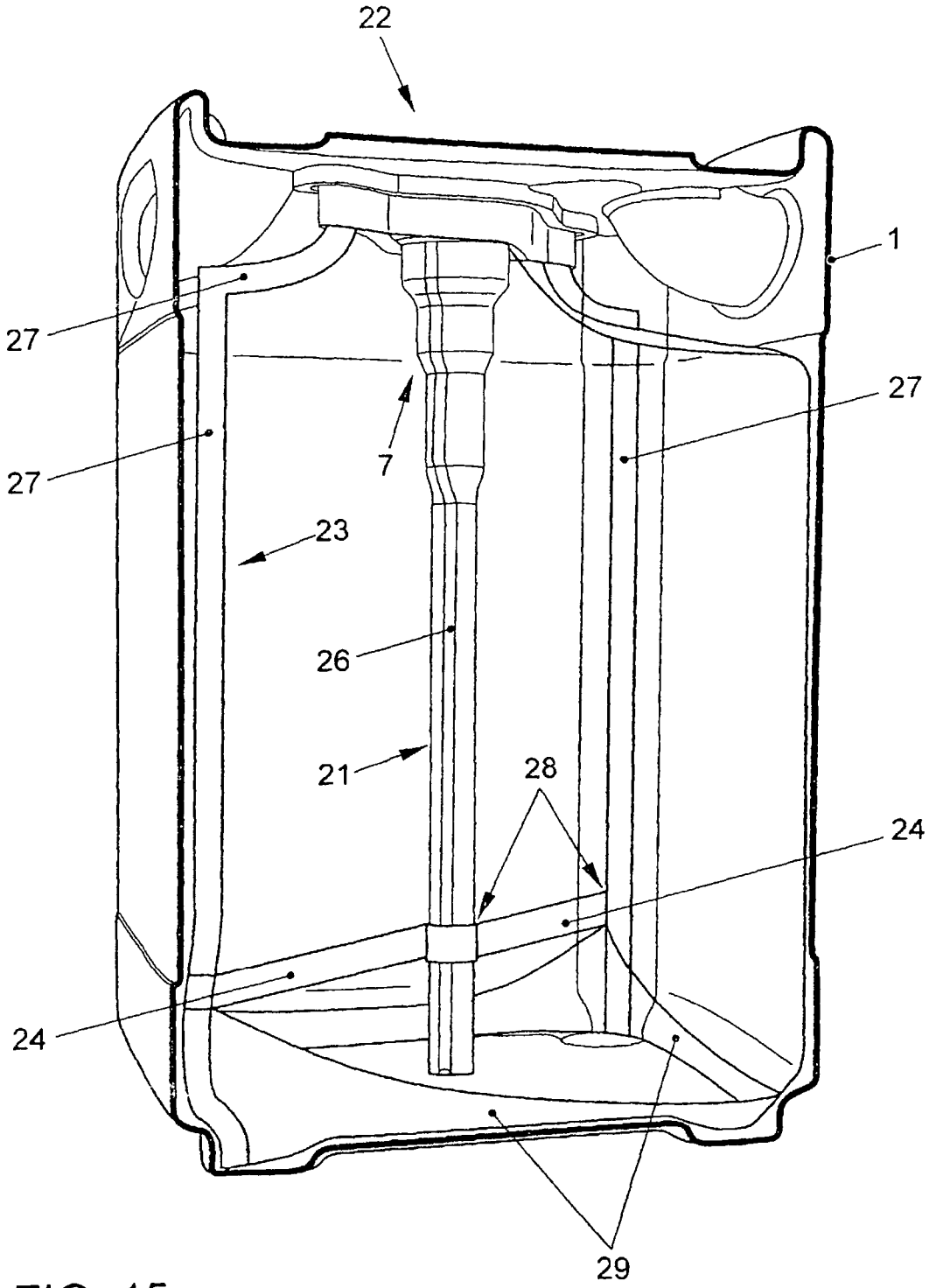
FIG. 15 shows the sectional view of FIG. 9, wherein the liner is connected to the valve assembly.

As can be seen in FIG. 15, a liner 23 is connected to the valve assembly 7. The liner 23 is made from a flexible material of one or more layers selected for their compatibility and mechanical strength and has a form commensurate with that of the casing 1 and required volume. For connecting the liner 23, the circumferential face of the body of the dry break extractor valve 17 comprises welding ribs 19 having beneficial features for welding extending peripherally around the dry break extractor valve 17. The edges of the opening of the liner 23 may be sealed to the valve assembly 7, in particular to the welding ribs 19 of the dry break extractor valve 17 by welding. With respect to the details of this connection between the liner 23 and the valve assembly 7, reference is made to WO 96/38349 and WO 98/45188, which are incorporated herein by reference.

Welded circumferential sections of the liner 23 are connected to the dip tube 21 by straps 24, which extend radialy from the tube 21 to the liner 23 as can be seen in FIG. 15. In detail, the liner 23 comprises welded seams 27 and welded gussets 29. The straps 24 are connected to the seams 27 and the dip tube 21 by the anchor points 28.

Additionally, a pressure balance valve (not shown) may be provided. This valve permits the entry of gases, e.g. air, to the space between the casing 1 and the liner 23 while prohibiting the escape of material to the outside of the casing 1 and to the general environment that may occur as a result of a rupture of the liner 23. The pressure balance valve is, for example, to be made of either a Gortex® membrane or a spring-actuated one-way or non-return valve. Generally, the pressure balance valve is open for the entry of any gas from an external source.

Additionally, the dip tube 21 incorporates a longitudinal groove 26 so that, as the liner 23 becomes empty and collapses onto the dip tube 21, the groove 26 may continue to permit a little air to travel from the top of the liner 23 to the bottom. The groove 26 is open to the pressure balance valve. The groove 26 will therefore assure that the final residue from the liner 23 and centre of the dip tube 21 can be displaced.

In addition, the casing 1 may include a recess or pocket (not shown) into which a transponder tracking device (not shown) is fixed. Alternatively, or in addition, provision is made for a bar code marking system. Furthermore, recessed panels 25 on each face of the casing 1 may be provided to accept a label to carry statutory and marketing information (see FIG. 5).

The use of the packaging assembly of the present invention will now be described:

At the site of manufacture, the dip tube 21 is connected to the valve assembly 7, which is already assembled. Then, the dip tube 21 is introduced into the liner 23, whereupon the rim of the liner 23 is welded to the welding ribs 19 of the dry break extractor valve 17. The straps 24 will hold the flexible dip tube 21 at the centre line and on the base of the liner 23 in such a manner that the liner 23 is not damaged and the tube bottom is in the optimum position to remove the maximum amount of the product contained in the liner. When this assembly is complete the liner is in a collapsed and flat condition for maximum efficiency in transport to the filling site.

At the filling site, the liner 23 is folded longitudinally and the liner 23 and valve assembly 7 will then be threaded into the casing 1 through the opening 9. The slits 11 serve to introduce the liner 23 and the centre of the opening 9 is adapted to hold the valve assembly 7 firmly. Once the valve assembly 7 with the liner 23 is mounted in the opening 9 of the casing 1, a special version of the Dry Break Coupling 8 called a filling head, can be attached, the valves opened and liner filled with the product to be contained and shipped.

The inside of the liner 23 is then filled via the valve assembly 7 and the dip tube 21 with the flowable material. As the liner 23 is flexible, it essentially expands in relation to the inner volume of the casing 1. However, some safety margin may remain in the space between the casing 1 and the liner 23. It is noted that the material may be filled in the absence of ambient air. In particular, the liner 23 can be filled using an inert gas purge that may also be retained during customer use and emptying. It is further noted that, when the liner 23 is filled, the volume of the material inside the liner 23 prevents the liner 23 from being removed from the casing 1.

The tamper evidence device 4 will then be mounted in the recess 10 surrounding the opening 9 of the casing 1. The tamper evidence device 4 will be mounted in such a manner that it cannot be removed without being irreparably damaged. The first section 2 of the tamper evidence device 4 covers the opening 22 of the dry break extractor valve 17 and the second section 3 covers the slits 11, which provide access to the space between the inside of the casing 1 and the liner 23. As the tamper evidence device 4 is irreversibly mounted, it prevents, on the one hand, the replacement of the liner 23 and, on the other hand, the filling or dispensing of material to or from the inside of the liner 23. Moreover, the tamper evidence device 4 provides a seal in case of a rupture of the liner 23 or a malfunction of the valve assembly 7.

The packaging assembly sealed by the tamper evidence device 4 can then be shipped to the end user. The end user lifts up the ring 5 to remove the centre or second section 3 of the tamper evidence 4 so as to access the dry break extractor valve 17. It is noted that the space between the liner 23 and the inside of the casing 1 is still sealed by the first section 2 of the tamper evidence device 4 so that even in the event of a rupture of the liner 23, no contamination of the user or environment can occur. The end user can then connect the corresponding dry break coupler 8 to the dry break extractor valve 17. The corresponding coupler 8 is, for example, connected to a hose with equipment for the intended dispense of the material stored in the packaging assembly.

By connecting the corresponding coupler 8 to the dry break extractor valve 17, the valve of the valve assembly 7 is opened as explained above. Then negative pressure may be applied through the dry break coupler 17 so that the flowable material stored within the liner 23 is drawn up through the dip tube 21 and the valve assembly 7 to the end user's equipment. This will lead to a collapsing of the liner 23. This collapsing is facilitated by the pressure differential between the inside of the liner and the outside ambient air pressure and made possible by the balance valve which permits the entry of air into the space between the casing 1 and the liner 23. Alternatively this may also be achieved by an excess of pressure being applied to the space between the liner 23 and casing 1. For example, it may be possible that a fluid is pressed into the space between the liner 23 and the casing 1. This fluid may be a gas or a liquid. In case the pressure is applied by means of a liquid, the volume of the liquid inserted may be metered so that the displaced volume from the inside of the liner 23 can be measured. It is noted that in the event of the material being partly used and then stored, the packaging assembly will not permit the drying and flaking of some materials and will thus extend the life of those materials liable to oxidise, dry prematurely or in any other way deteriorate.

Once all material has been dispensed and the liner 23 is empty and collapsed, the packaging assembly is shipped back to the manufacturer or to a third party. The remains of the tamper evident device 4 and the liner 23 are then removed together with the valve assembly 7. Optionally these parts are disposable, when compared to current practices the volume of waste is reduced. Furthermore, the flexible liner permits very low residual volumes to be achieved in the liner 23 after extraction is complete. Moreover, an almost constant and small residual volume is achieved.

In this embodiment the casing 1 can be, reusable. As a result of using the liner 23, the inside of the casing 1 usually does not need to be cleaned and cross-contamination is avoided. In other embodiments the casing and the liner may be advantageously used as disposable or multi use.

REFERENCE NUMBERS USED ON FIGS. 1 TO 15

1 Casing
2 First section of the tamper evidence device
3 Second section of the tamper evidence device
4 Tamper evidence device
5 Ring to pull off the second part of the tamper evidence device
6 Carrier handle
7 Valve assembly

8 Corresponding dry break coupler matching the dry break extractor valve 17 to dispense the contents of the liner
9 Opening of the casing
10 Recess for the tamper evidence device
11 Slits
12 Seal ring
13 Retaining ring
14 Seal support
15 Spring
16 Centre post of the valve assembly
17 Dry break extractor valve
18 Grooves of the dry break coupler
19 Welding ribs for coupling the liner
20 Connection for the dip tube
21 Dip tube
22 Opening of the dry break extractor valve
23 Liner
24 Straps
25 Recessed panels
26 Groove of the dip tube
27 Welded seams
28 Anchor points
29 Welded gussets
30 Body

The invention claimed is:

1. Packaging assembly for flowable materials comprising:
a casing having at least one opening,
a valve assembly mounted in the opening of the casing, and
a flexible liner for accommodating the flowable material, said flexible liner being housed in the casing and connected to the valve assembly;
wherein the valve assembly comprises a dry break extractor valve adapted to be coupled to a corresponding coupler for closed transfer dispense of the flowable material from the packaging assembly; and
wherein the opening of the casing has a first section formed to receive the valve assembly and a second section formed so that the liner connected to the valve assembly can be brought in or out of the casing.

2. Packaging assembly according to claim 1, wherein the casing is reusable.

3. Packaging assembly according to claim 1, wherein the liner is disposable.

4. Packaging assembly according to claim 1, wherein the valve assembly is disposable.

5. Packaging assembly according to claim 1, wherein the liner and valve assembly are reusable.

6. Packaging assembly according to claim 1, further comprising a tamper evidence device sealing the opening of the casing, said tamper evidence device preventing, on the one hand, the replacement of the liner and, on the other hand, the filling or dispensing of material to or from the inside of the liner without visible evidence of such replacement or filling or dispensing.

7. Packaging assembly for flowable materials comprising:
a casing having at least one opening,
a valve assembly mounted in the opening of the casing,
a flexible liner for accommodating the flowable material, said flexible liner being housed in the casing and connected to the valve assembly, and
a tamper evidence device sealing the opening of the casing;
wherein the valve assembly comprises a dry break extractor valve adapted to be coupled to a corresponding coupler for closed transfer dispense of the flowable material from the packaging assembly;
wherein the tamper evidence device comprises a first section which seals a dispense opening of the valve assembly and a second section which seals the part of the opening of the casing which provides access to the space between the inside of the casing and the liner.

8. Packaging assembly according to claim 6, wherein the tamper evidence device is adapted to be used once only.

9. Packaging assembly according to claim 6, wherein the casing comprises a recess in which the tamper evidence device is fixed.

10. Packaging assembly according to claim 1, wherein the second section is formed by two aligned slits arranged on opposite sides of the first section of the opening.

11. Packaging assembly according to claim 1, wherein the valve assembly and a rim of the liner are sealed to one another.

12. Packaging assembly according to claim 11, wherein the valve assembly comprises at least one rib to which the rim of the liner is sealed.

13. Packaging assembly according to claim 11, wherein the rim is sealed to the valve assembly by welding.

14. Packaging assembly according to claim 1, wherein the valve assembly comprises a self-sealing valve sealing the inside of the liner from the outside of the packaging assembly.

15. Packaging assembly according to claim 14, wherein the self-sealing valve can only be opened by connecting a particular corresponding coupler to the dry break extractor valve to permit a closed transfer of the flowable material.

16. Packaging assembly according to claim 1, wherein the flowable material can be dispensed by applying a negative pressure to the corresponding coupler coupled with the dry break extractor valve.

17. Packaging assembly according to claim 1, wherein the valve assembly is connected to a dip tube that extends from the valve assembly to a point close to the bottom of the liner.

18. Packaging assembly according to claim 17, wherein the dip tube is flexible.

19. Packaging assembly for flowable materials comprising:
a casing having at least one opening,
a valve assembly mounted in the opening of the casing, and
a flexible liner for accommodating the flowable material, said flexible liner being housed in the casing and connected to the valve assembly;
wherein the valve assembly comprises a dry break extractor valve adapted to be coupled to a corresponding coupler for closed transfer dispense of the flowable material from the packaging assembly;
wherein the valve assembly is connected to a dip tube that extends from the valve assembly to a point close to the bottom of the liner; and
wherein the dip tube is secured within the liner by straps that extend from the tube to circumferential sections of the liner.

20. Packaging assembly according to claim 10, wherein the dry break extractor valve involves an opening for receiving the corresponding coupler and two side parts opposite one another which both taper away from said opening.

21. Packaging assembly according to claim 20, wherein the tapered side parts end where the slits of the opening of the casing begin.

22. Packaging assembly according to claim 20, wherein the tamper evidence device seals the opening of the dry break extractor valve as well as the slits of the opening of the casing.

23. Packaging assembly according to claim 1, wherein the flexible liner is adapted to expand commensurately with the inner volume and form of the casing.

24. Packaging assembly according to claim 1, wherein the casing comprises a pressure balance valve, wherein said pressure balance valve permits the entry of air to a space between the casing and the liner while prohibiting the escape of the flowable material.

25. Packaging assembly according to claim 17, wherein the dip tube incorporates a groove which is open to the inside of the liner.

26. Packaging assembly for flowable materials comprising:

a casing having at least one opening therein;

a valve assembly mounted in the at least one opening of the casing; and flexible liner means for containing the flowable material, the flexible liner means being housed in the casing and having a fluid tight connection to the valve assembly;

the valve assembly comprising a dry break extractor valve means capable of connection to a coupler for closed discharge of the flowable material from the packaging assembly; and the opening of the casing having a first section formed to receive the valve assembly and a second section formed so that the liner connected to the valve assembly can be brought in or out of the casing.

* * * * *